US011019905B2

(12) United States Patent
Gaon et al.

(10) Patent No.: US 11,019,905 B2
(45) Date of Patent: Jun. 1, 2021

(54) COMB CLEANING ADAPTER AND METHODS OF USE THEREOF

(71) Applicants: Ruth Mercedes Gaon, Ein Vered (IL); Maya Arieli Vilkomirski, Ein Vered (IL); Yoav Gaon, Ein Vered (IL)

(72) Inventors: Ruth Mercedes Gaon, Ein Vered (IL); Maya Arieli Vilkomirski, Ein Vered (IL); Yoav Gaon, Ein Vered (IL)

( * ) Notice: Subject to any disclaimer, the term of this patent is extended or adjusted under 35 U.S.C. 154(b) by 376 days.

(21) Appl. No.: 15/685,323

(22) Filed: Aug. 24, 2017

(65) Prior Publication Data

US 2018/0055189 A1 Mar. 1, 2018

Related U.S. Application Data

(60) Provisional application No. 62/379,232, filed on Aug. 24, 2016.

(51) Int. Cl.

| | |
|---|---|
| ***A45D 24/42*** | (2006.01) |
| ***A45D 24/10*** | (2006.01) |
| ***A45D 24/04*** | (2006.01) |
| ***A45D 24/18*** | (2006.01) |
| *A45D 24/00* | (2006.01) |

(52) U.S. Cl.

CPC ..... *A45D 24/42* (2013.01); *A45D 24/04* (2013.01); *A45D 24/10* (2013.01); *A45D 24/18* (2013.01); *A45D 2024/002* (2013.01)

(58) Field of Classification Search

CPC .. A46B 17/065; A46B 15/0095; D01G 19/22; A45D 24/30; A45D 24/00; A45D 24/04; A45D 24/06; A45D 24/10; A45D 24/18; A45D 24/32; A45D 24/38; A45D 24/40; A45D 24/42; A45D 24/44; B08B 11/00; B08B 11/02; B08B 11/04; G02B 6/25; Y10T 24/3909; Y10T 24/3918; Y10T 24/392; Y10T 24/3931; Y10T 24/3953; Y10T 24/394; Y10T 24/3947

USPC ..... 15/401; 222/105; 206/443

See application file for complete search history.

(56) References Cited

U.S. PATENT DOCUMENTS

| | | | | |
|---|---|---|---|---|
| 2,159,432 | A * | 5/1939 | Enns | A46B 7/023 15/185 |
| 2,175,986 | A * | 10/1939 | Crawford | A45D 24/40 15/39 |
| 5,353,817 | A * | 10/1994 | Kantor | A01K 13/002 119/625 |
| 6,427,633 | B1 * | 8/2002 | Ogden | A01K 13/002 119/600 |
| 8,276,595 | B2 * | 10/2012 | Maor | A45D 24/30 119/609 |
| 2012/0167908 | A1 * | 7/2012 | Krishevski | A45D 24/30 132/119 |

(Continued)

*Primary Examiner* — Orlando E Aviles
*Assistant Examiner* — Joel D Crandall
(74) *Attorney, Agent, or Firm* — The IP Law firm of Guy Levi, LLC

(57) ABSTRACT

The disclosure relates in general to a comb cleaning adaptor. Specifically, the disclosure relates to an adapter for a comb, or an adapter integrated with a comb, operating between a retracted and extended positions, configured to be reversibly coupled to the comb allowing its removal and reciprocally articulate a cleaning head along the comb's teeth such that at the retracted position, the adapter is still coupled to the comb but does not interfere with the combing activity.

19 Claims, 11 Drawing Sheets

(56) References Cited

U.S. PATENT DOCUMENTS

| | | | | |
|---|---|---|---|---|
| 2014/0026822 | A1* | 1/2014 | Harris, II | A01K 13/002 119/628 |
| 2015/0045856 | A1* | 2/2015 | Ingersoll | A61N 1/322 607/79 |
| 2017/0258197 | A1* | 9/2017 | Maor | A45D 24/30 |

* cited by examiner

COMB CLEANING ADAPTER AND METHODS OF USE THEREOF

BACKGROUND

The present disclosure is directed in general to a comb cleaning adaptor. Specifically, the disclosure is directed to an adapter configured be reversibly coupled to a comb and reciprocally articulate a cleaning head along the comb's teeth.

Cleaning of various combs is an important step in maintaining health and wellbeing. For example, removal of the dirt or the like adjacent the roots or bases of a hair comb's teeth, the point of accumulation and the chief source of infection.

Likewise, head lice infest hair. Once in hair, the head lice lay eggs which are known as nits. The nits are small greyish-white oval-shaped eggs glued at an angle to the side of a hair shaft. Head lice are mainly transmitted by head-to-head contact but can also be spread through the sharing of personal articles. Whether or not using chemical treatment, all of the nits (lice eggs) and lice must be manually removed from the head. This manual removal is typically done with a lice comb having multiple, closely spaced tines which will remove the lice and nits as it passes through hair. It is important that nit and/or lice combs be cleaned consistently and thoroughly between successive combings and certainly between users, so that lice and nits are not spread.

Therefore there is a need for an adapter for combs such as lice combs that can be used to consistently and effectively clean the full length of the comb's teeth or tines.

SUMMARY

In an embodiment, provided herein is a comb cleaning adapter, the adapter configured to reversibly operate between a retracted position and an expanded position, the adapter comprising: a platform having a distal end and a proximal end, configured to receive and engage a portion of a comb, wherein the comb having a head portion and a plurality of elongated teeth extending from the head portion to a given length; an articulating lever having an anterior end and a posterior end, hingedly coupled at the anterior end to the platform's proximal end, the articulating slab configured to rotate at a predetermined arc relative to the platform; and a cleaning head operably coupled to the articulating lever slab, and slidably coupled to the platform, wherein the cleaning head configured to frictionally slidably couple to the plurality of elongated teeth of the comb, wherein rotation of the articulating lever along the predetermined arc is configured to articulate the cleaning head proximally along the plurality of the comb's teeth.

In another embodiment, provided herein is a method of cleaning a comb, implementable with the adapter described herein, comprising: Providing a comb; rotating the articulating lever to an extended position; engaging the comb and the platform; retracting the articulating lever; combing; and rotating the articulating lever to an extended position, thereby articulating the cleaning head proximally along the plurality of elongated comb teeth, thereby cleaning the plurality of elongated comb teeth.

Further, provided herein is a method of rapidly and positively detecting the presence of lice, nits and/or dandruff, implementable with the adapter described herein, comprising: Providing a comb, whether integrated into the cleaning adapter or separate; rotating the articulating lever slab to an extended position; optionally engaging the comb (if separate from the adapter) and the platform; retracting the articulating lever slab; combing a scalp or area of interest; rotating the articulating lever to a fully extended position, thereby articulating the cleaning head proximally along the plurality of elongated comb teeth; and inspecting the cleaning head face for presence of lice, nits and/or dandruff.

In an embodiment, provided herein is an integrated comb cleaning adapter comprising: a platform having a distal end and a proximal end, having a plurality of elongated teeth extending from the distal end to a given length; an articulating lever slab having an anterior end and a posterior end, hingedly coupled at the anterior end to the platform's proximal end, the articulating lever slab configured to rotate at a predetermined arc relative to the platform; and a cleaning head operably coupled to the articulating lever slab, and slidably coupled to the platform, wherein the cleaning head configured to frictionally slidably couple to the plurality of elongated teeth, wherein rotation of the articulating lever slab along the predetermined arc is configured to articulate the cleaning head proximally along the plurality of teeth.

In yet another embodiment, provided herein is a kit of parts capable of being assembled into a comb cleaning adapter, the adapter configured to reversibly operate between a retracted position and an expanded position, comprising: a platform having a distal end and a proximal end, configured to receive and engage a portion of a comb, wherein the comb having a head portion and a plurality of elongated teeth extending from the head portion to a given length; an articulating lever having an anterior end and a posterior end, hingedly coupled at the anterior end to the platform's proximal end, the articulating slab configured to rotate at a predetermined arc relative to the platform; and a cleaning head operably coupled to the articulating lever slab, and slidably coupled to the platform, wherein the cleaning head configured to frictionally slidably couple to the plurality of elongated teeth of the comb, wherein rotation of the articulating lever along the predetermined arc is configured to articulate the cleaning head proximally along the plurality of the comb's teeth.

These and other features of the articulating comb cleaning adapter, methods of use and kits described herein will become apparent from the following detailed description when read in conjunction with the drawings, which are exemplary, not limiting, and wherein like elements are numbered alike in several figures.

BRIEF DESCRIPTION OF THE DRAWINGS

For a better understanding of the articulating comb cleaning adapter described herein, with regard to the devices, methods and kits embodiments thereof, reference is made to the accompanying drawings, in which like numerals designate corresponding elements or sections throughout and in which.

DETAILED DESCRIPTION

Figure 1:
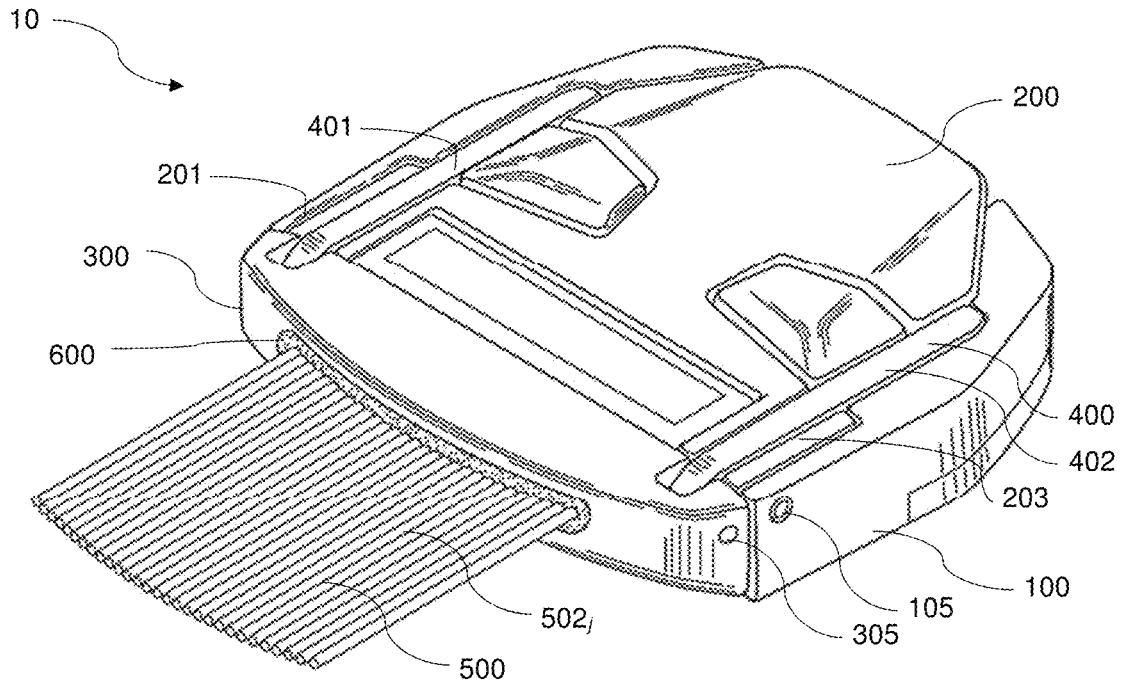
FIG. 1, illustrates a perspective view of an embodiment of the adapter in its retracted state.
Figure 2A:
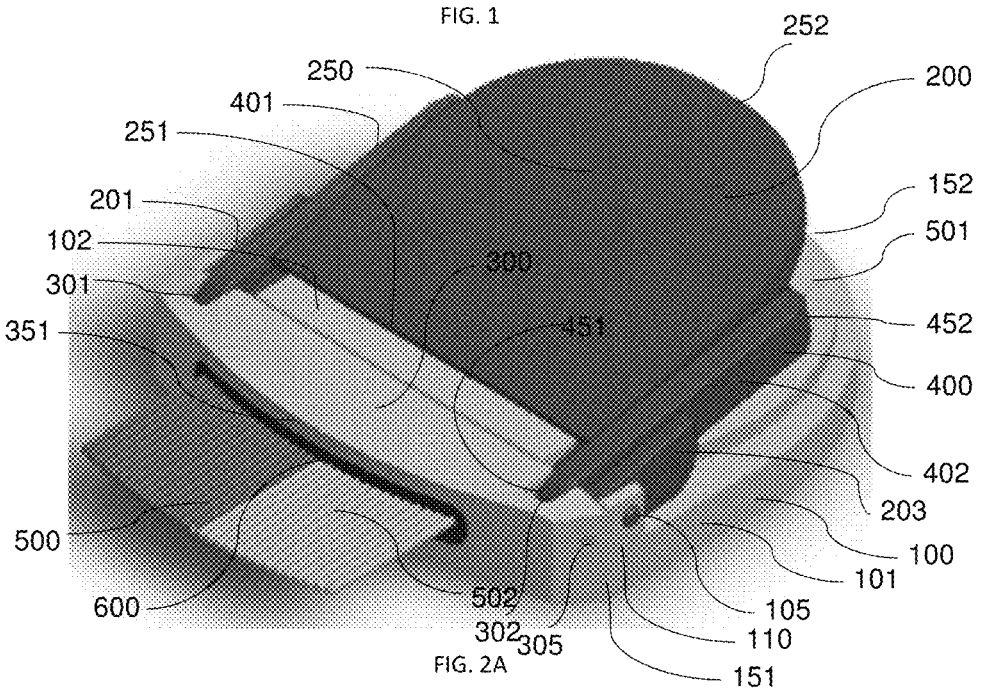
FIG. 2A, is a front perspective view of another embodiment of the adapter in a semi expanded state, with a rear perspective illustrated in FIG. 2B.
Figure 2B:
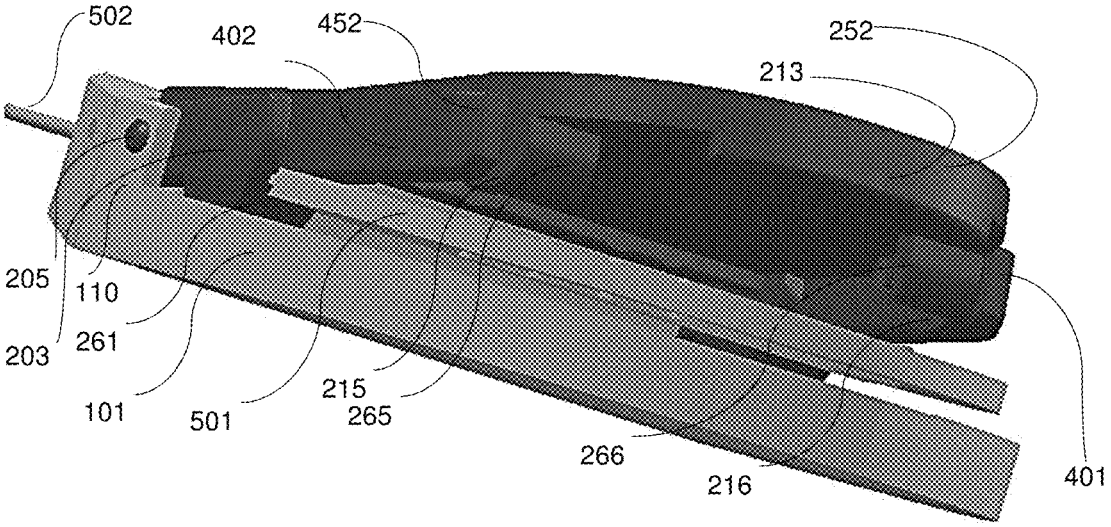

Provided herein are embodiments of a cleaning adapter for a comb, kits capable of being assembled to form the comb adapters described and methods of use of the adapter. In another embodiment, provided herein are adapters configured be reversibly coupled to a variety of combs, lice combs, pitchforks etc., and reciprocally articulate a cleaning head back and forth along the comb's teeth. Likewise, provided are A more complete understanding of the components, methods, adapters, kits capable of being assembled to form the comb adapters described and devices disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof, their relative size relationship and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning now to FIGS. 1, 2A-2B and 8A, illustrating an embodiment of comb cleaning adapter 10, adapter 10 configured to reversibly operate between a retracted position (see e.g., FIG. 1) and expanded position (see e.g., FIG. 8A), adapter 10 comprising: platform 100 having distal end 152 and proximal end 151 (see e.g., FIG. 2A), configured to receive and engage a portion of comb 500, wherein comb 500 having head portion 501 and plurality of elongated teeth $\mathbf{502}_j$ extending from head portion 501 to a given length. Also shown is articulating lever slab 200 having anterior end 251 and posterior end 252, hingedly coupled at anterior end 251 to platform 100 proximal end 151, where articulating slab 200 configured to rotate at a predetermined arc relative to platform 100. Also shown is cleaning head 300 operably coupled to articulating lever slab 200, and slidably coupled to platform 100, wherein cleaning head 300 can be configured to frictionally and slidably couple to plurality of elongated teeth $\mathbf{502}_j$ of comb 500, wherein rotation of articulating lever slab 200 along the predetermined arc is configured to articulate cleaning head 300 proximally along plurality of the comb 500 teeth $\mathbf{502}_j$.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

In addition, the term "slidably" or "slidably coupled" refers to movement of one surface (for example cleaning head 300) over a second surface (for example, platform 100) while maintaining smooth continuous contact between the two surfaces. In another embodiment, the term "slidably coupled" means a state in which two or more components are coupled to one another such that at least one of the components (e.g., cleaning head 300) at least slides with respect to another component (e.g., platform 100). Likewise; the terms "slide," "slid" or "sliding" are defined as moving, gliding or passing along or through a surface or a space, although continuous contact at each point along the path is not necessarily required.

The term "engage" and various forms thereof, when used with reference to, for example, retention of a portion of comb 500, refer to the application of any forces that tend to hold the a portion of comb 500 and platform 100 together against inadvertent or undesired separating forces (e.g., such as may be introduced during use of the adapter). It is to be understood, however, that engagement does not in all cases require an interlocking connection that is maintained against every conceivable type or magnitude of separating force.

Figure 3A:
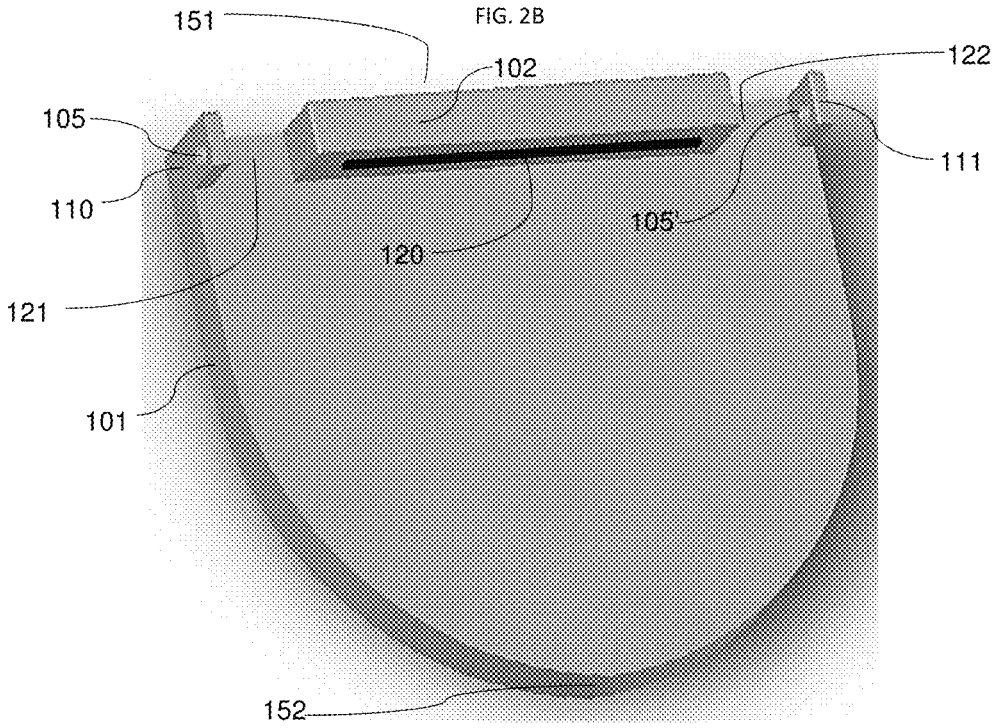
FIG. 3A, is top perspective view of the base platform, with a front view of the platform illustrated in FIG. 3B.
Figure 3B:
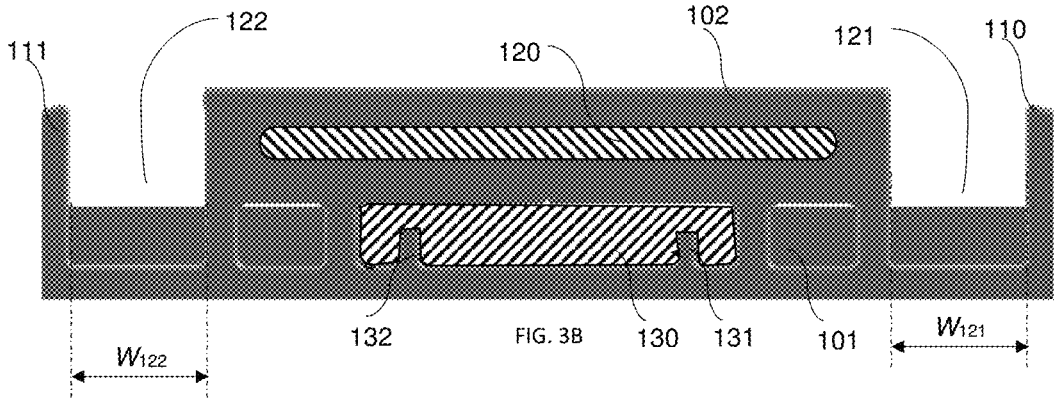

Turning now to FIGS. 1 to 3B, platform 100 used in comb cleaning adapter 10 further comprising: stage 102 disposed centrally along proximal end 151 (see e.g., FIG. 3A) of platform 100, with stage 102 defining opening 120 (see e.g., FIG. 3A, 3B), configured to accommodate and engage head portion 501 of comb 500 (see e.g., FIG. 3A). Also illustrated in FIG. 3B, is pocket 130 disposed in platform 100 base 101, pocket 130 configured to engage and slidably couple to a portion of cleaning head 300 such as elongated slab 340 (see e.g., FIG. 6A, 8C).

Figure 4A:
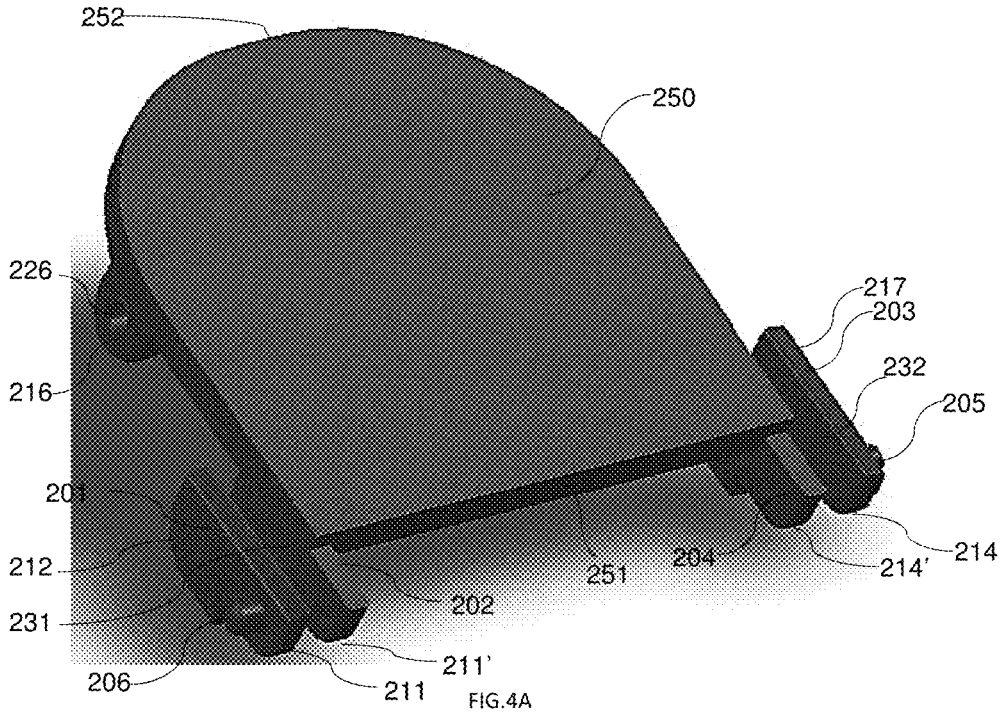
FIG. 4A, is top front perspective of the articulating lever with front elevation view illustrated in FIG. 4B, side elevation view illustrated in FIG. 4C and a bottom perspective view illustrated in FIG. 4D.
Figure 4B:
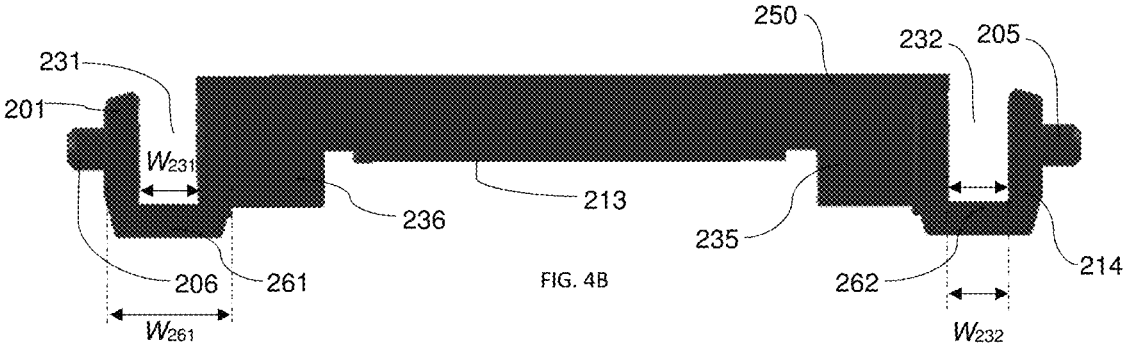
Figure 4C:
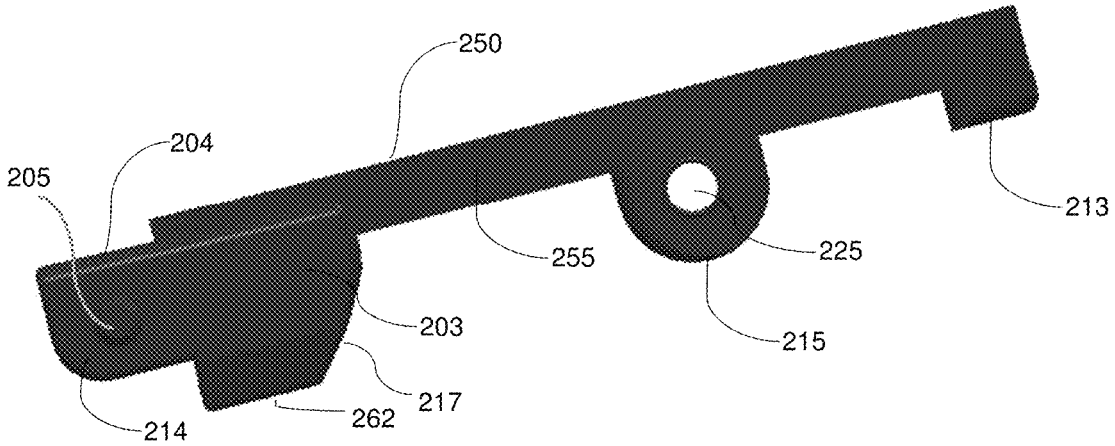

In addition, platform 100 further comprising pair of vertical members 110, 111 disposed at equidistance from stage 102 along proximal end 151 of platform 100, each vertical member 110, 111 defining recess 121, 122, each recess 121, 122 configured to receive a portion of articulating slab 200. As illustrated in FIG. 3B, pocket 130 can further comprise a pair of stoppers 131, 132, configured to reversibly engage tabs 346, 347, disposed at the distal end of elongated slab 340 (see e.g., FIG. 6A), thereby limiting the rotation of articulating lever slab 200 such that cleaning head 300 does not disengage from plurality of comb teeth $\mathbf{502}_j$. As illustrated in FIG. 3A, vertical members 110, 111, can each further define apertures 105, 106, configured to receive hinge pins 205, 206 (see e.g., FIG. 4B) and be used to hingedly couple articulating lever slab 200 to platform 100 (see e.g., FIG. 2B).

Figure 4D:
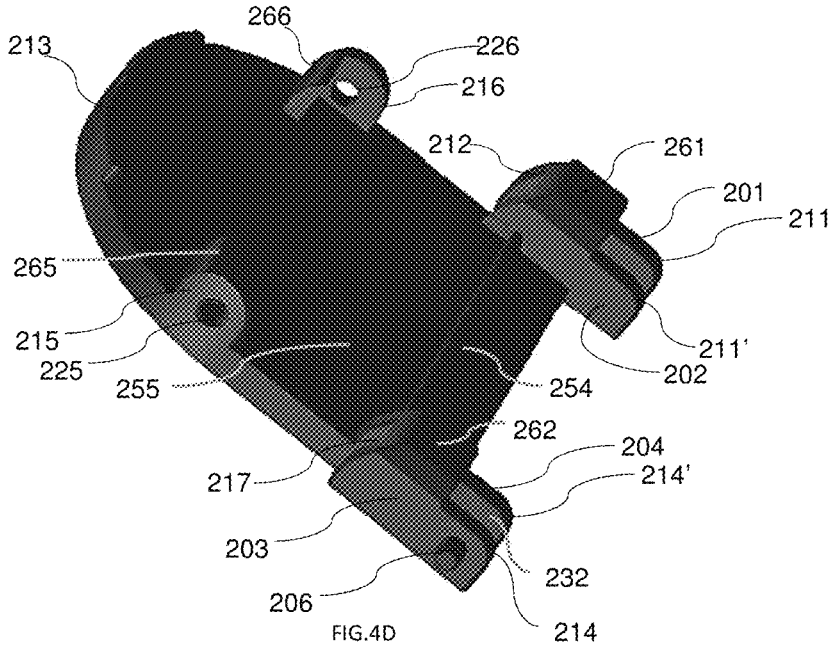

Turning now to FIGS. 1 to 4D, illustrating articulating lever slab 200 having apical side 250 and basal side 255 (see e.g., FIG. 4C), with anterior end 251 and posterior end 252 (see e.g., FIG. 4A), further comprising cross bar 254 (see e.g., FIG. 4D, 8B) disposed toward anterior end 251 of articulating lever slab 200. Cross bar 254 can be used to further interlock with head portion 501 of comb 500 in the retracted state (see e.g., FIG. 1). Also shown in FIGS. 4A-4D are a pair of braces disposed on opposite sides along anterior end 251 and extending basally from basal side 255 and anteriorly from anterior end 251. As illustrated, each brace comprises: internal wall 202, 204 extending basally from basal side 255 of articulating lever slab 200; floor section 261, 262; and external wall 201, 203 together (202-261-201 and 204-262-203 respectively) forming an open U-shaped channel (see e.g., FIG. 4B), wherein each of recesses 121, 122 defined by pair of vertical members 110, 111 and stage 102 disposed on platform 100 base 101, can be configured to accommodate and hingedly couple to each of the braces formed by internal wall 202, 204 extending basally from basal side 255 of articulating lever slab 200; floor section 261, 262; and external wall 201, 203 together (202-261-201 and 204-262-203 respectively). Also shown in FIGS. 4B, 4D, are hinge pins 205, 206, extending outward from external brace walls 201, 203 respectively. Hinge pins 205, 206 can be engaged in apertures 105, 106 defined in vertical members 110, 111 respectively.

In an embodiment, the term "accommodate" refers to the ability of an accommodating element (e.g., each of recesses 121, 122 defined by pair of vertical members 110, 111 and stage 102 disposed on platform 100 base 101) to allow passage or retention of another element (e.g., the braces formed by internal wall 202, 204 extending basally from basal side 255 of articulating lever slab 200; floor section 261, 262; and external wall 201, 203 together (202-261-201 and 204-262-203 respectively)) at close tolerance, without substantial space for other elements or components. As illustrated the width ($W_{121}$, $W_{122}$) of recesses 121, 122 respectively, (see e.g., FIG. 3B), can be configured to accommodate width $W_{261}$, $W_{262}$ respectively (see e.g., FIG. 4B, 2A, 8A). As further illustrated in FIG. 4C internal walls 202, 204; and external walls 201, 203 have a beveled posterior facet 212 (212'), 217 (217') and a basally rounded edge 211 (211') and 214 (214') for the external (and internal) walls. Basally rounded edge 211 (211') and 214 (214') are configured to be received within recesses 121 and 122 respectively.

Figure 5A:
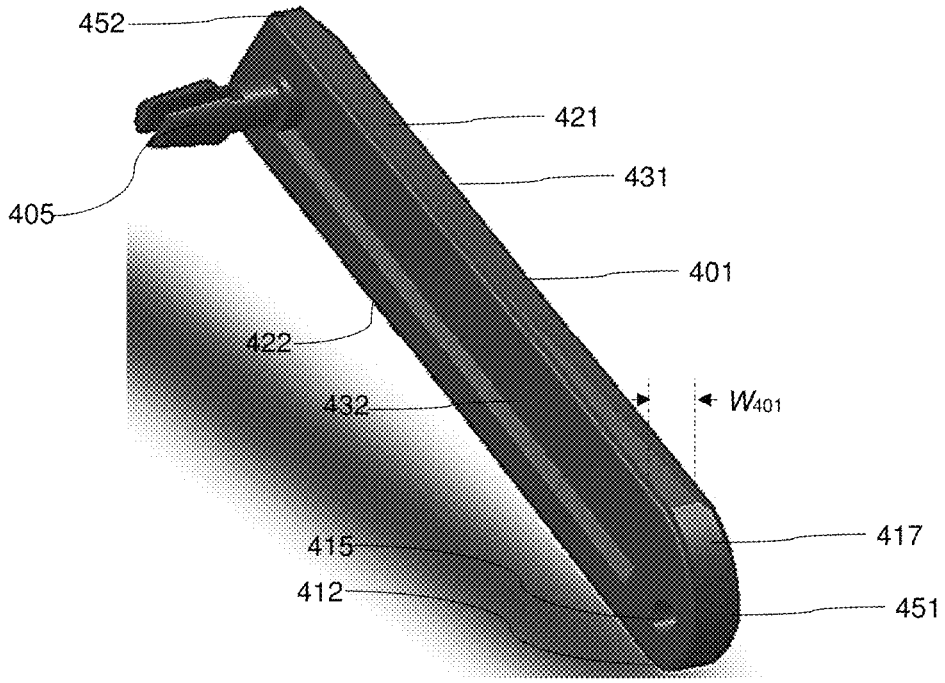
FIG. 5A, is a front perspective view from the internal side of one of the pair of articulating arms, with the internal side elevation view illustrated in FIG. 5B and the external side elevation view illustrated in FIG. 5C, the other articulating arm being a mirror image of FIGS. 5A-5C.
Figure 5B:
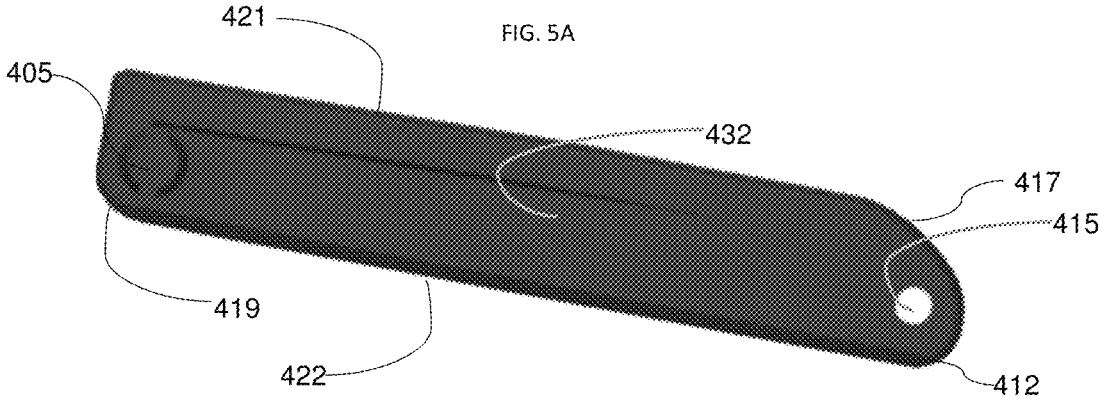
Figure 5C:
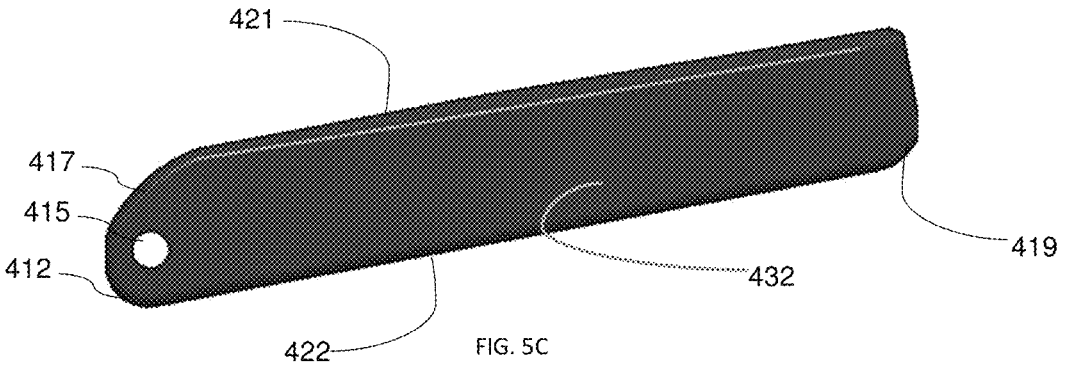
Figure 8A:
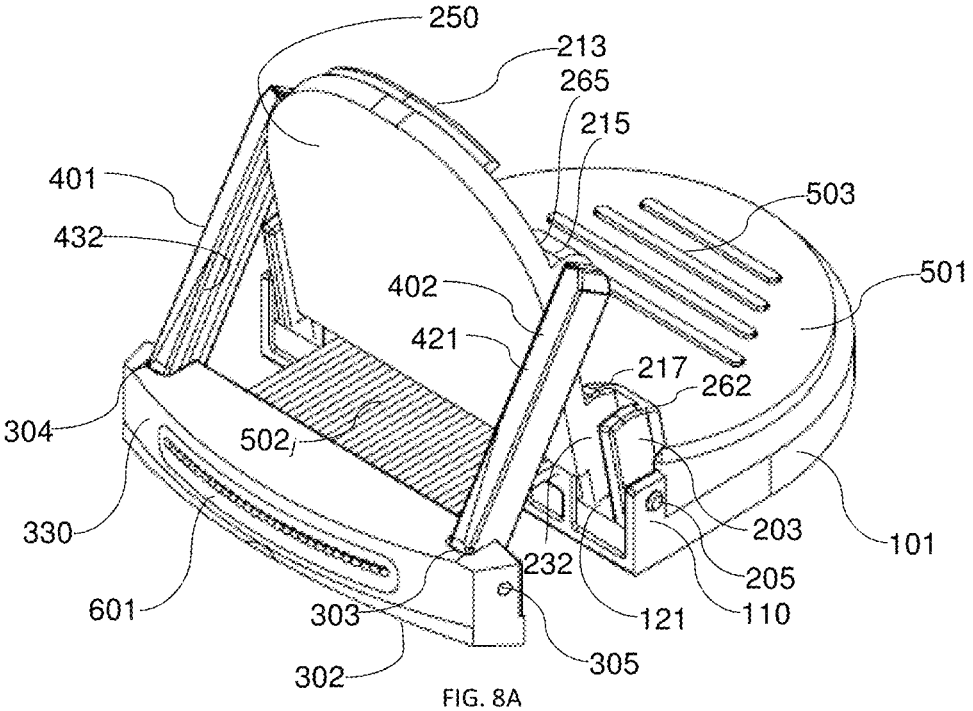
FIG. 8A is a front perspective view of an embodiment of the adapter in its extended state, with the rear perspective view thereof illustrated in FIG. 8B and bottom plan view thereof illustrated in FIG. 8C.
Figure 8B:
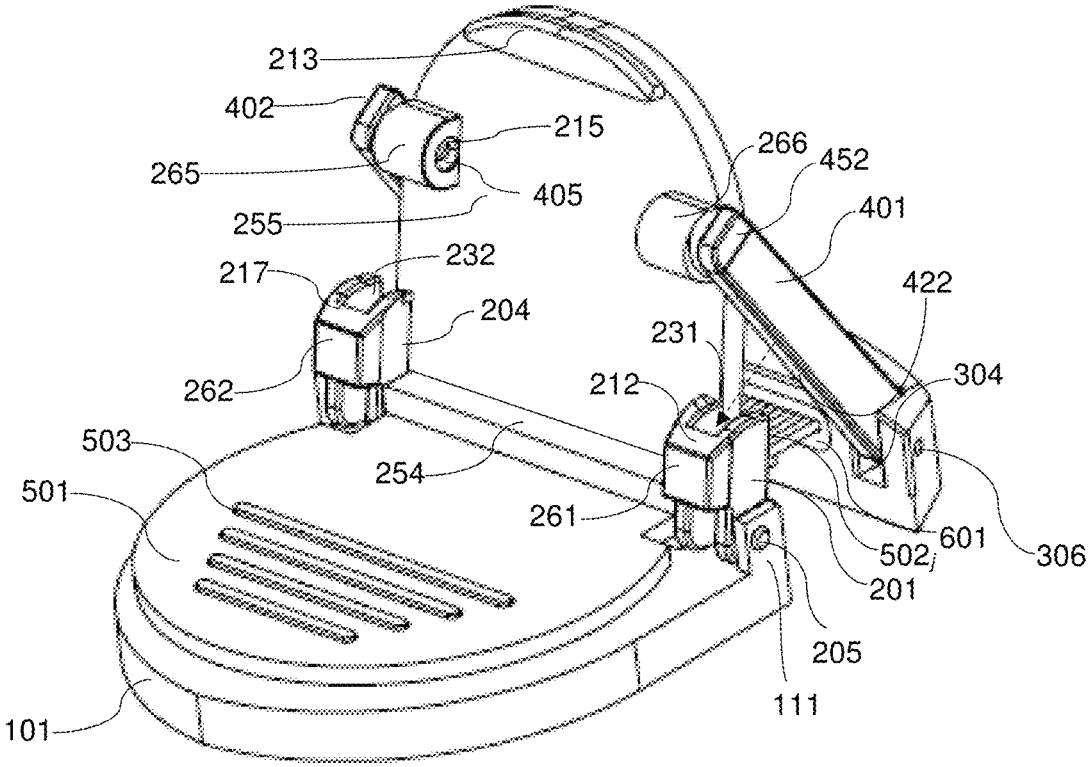
Figure 8C:
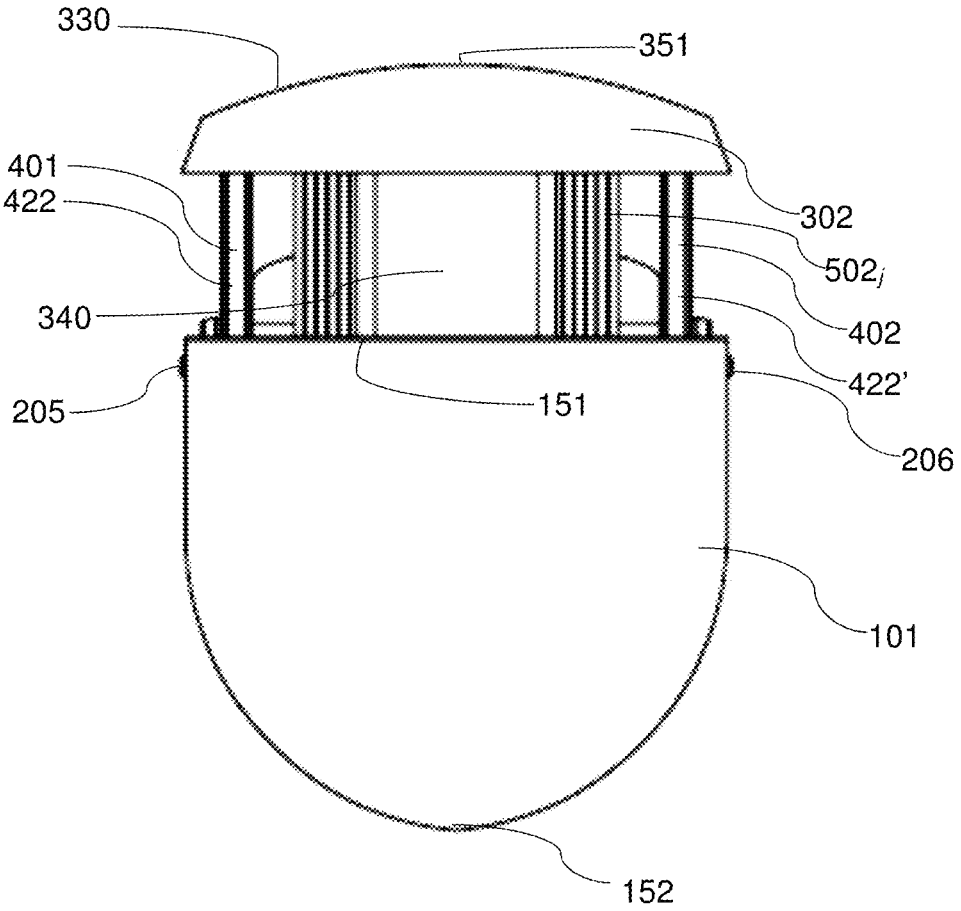

As illustrated (see e.g., FIGS. 3C, 3D, 8B), articulating lever slab 200 further comprises a pair of knuckles 265, 266 defining bores 215, 216 respectively, disposed toward posterior end 252 of articulating lever slab 200, each of knuckles 265, 266 configured to hingedly couple to distal portion 452 of articulating arm 400 (see e.g., FIG. 5A, 8B).

Turning now to FIGS. 1-7, whereby cleaning head 300 (see e.g., FIG. 6A) comprises upper surface 301 and lower surface 302, proximal end 351 and distal end 352, cleaning head 300 defines aperture 320 configured to receive and engage elastomeric insert 600. As illustrated in FIGS. 6A, 6B, cleaning head 300 further comprises elongated slab 340 extending distally from lower surface 302 of cleaning head 300, whereby elongated slab 340 further comprises pair of resilient extensions 341, 342, each resilient extension terminating in tab 346, 347 respectively and forming groove 343, 344 respectively with elongated slab 340, with tabs 346, 347 configured to be engaged and elongated slab 340 being slidably coupled within pocket 130 in base 101 of platform 100. In an embodiment, elongated slab 340 extending distally from lower surface 302 of cleaning head 300 can be configured to limit the arc of rotation of articulating lever slab 200 and limit the proximal movement of cleaning head 300 along plurality of elongated comb teeth $\mathbf{502}_j$ (see e.g., FIG. 8B, 8C).

Figure 7:
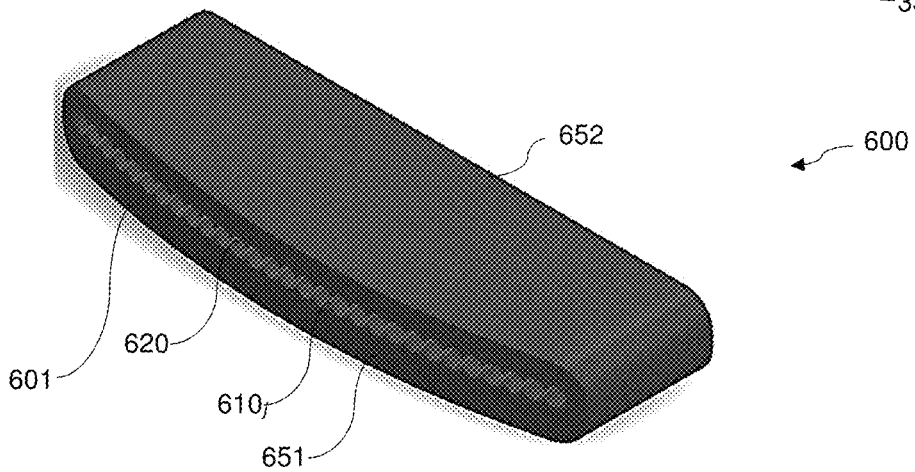
FIG. 7 is a top front perspective view of the elastomeric insert sleeve.

As illustrated in FIGS. 1 and 7, the insert is elastomeric sleeve 600 having wall 601 defining slit 620 with plurality of opposing protrusions $\mathbf{610}_i$ configured to frictionally slidably couple to plurality of elongated comb teeth $\mathbf{502}_j$. The term "elastomer," as used herein, refers to any polymer or combination of polymers consistent with the ASTM D1566 definition of "a material that is capable of recovering from large deformations, for example, carboxylated nitrile elastomers, acrylic elastomers, carboxylated polybutadienes, grafted ethylene/propylene/diene terpolymers, epichlorohydrin elastomers or mixtures of these polymers with the same elastomers but ungrafted, such as nitrile rubbers, hydrogenated nitriles, polybutadienes and ethylene/propylene/diene terpolymers, by themselves or mixed and an elastomer combination comprising one or more of the foregoing.

Figure 6A:
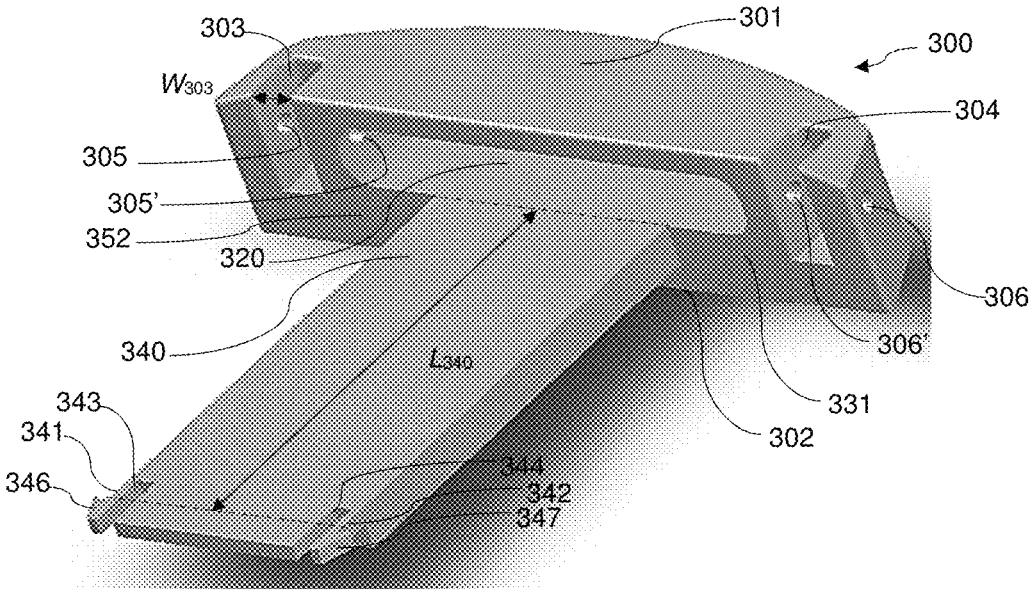
FIG. 6A is a rear perspective view of the cleaning head, with a front view illustrated in FIG. 6B.
Figure 6B:
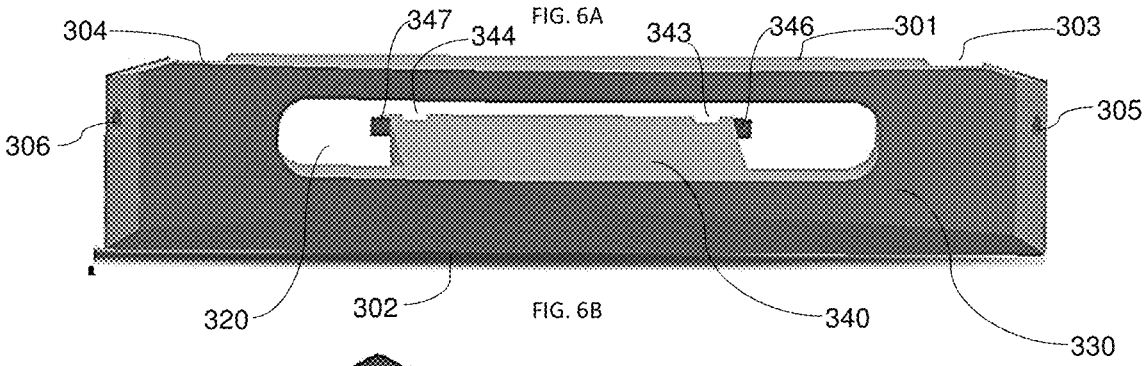

Also illustrated in FIGS. 6A, 6B, are pair of grooves 303, 304 cut into front facet 330 of cleaning head 300 and disposed on opposite sides along proximal end 351 (see e.g., FIG. 6A) of cleaning head 300, wherein each of grooves 303, 304 can further define bores 305, 305' and 306, 306' configured to receive and engage a hinge pin (not shown) and hingedly couple to proximal portion of articulating arms 401 and 402 respectively.

Turning now to FIGS. 5A-5C, and 8A-8C, illustrating adapter 10 further comprising pair of articulating arms 401, 402 (See e.g., FIG. 1), wherein each articulating arm 401, 402 having a proximal end 451 hingedly coupled to cleaning head 300 (e.g., at grooves 303, 304) and distal end 452 hingedly coupled to knuckles 265, 266 (respectively) disposed on basal side 255 of articulating lever slab 200 (see e.g., FIG. 4D, 8B). As illustrated further (see e.g., FIG. 5A), each of articulating arms 401, 402 (being a mirror image of articulating arm 401 illustrated in FIG. 5A-5C) has internal side 432 and external side 431, as well as an upper surface 421 and a lower surface 422, with hinge pin 405 (which can be a detent in another embodiment) being disposed toward distal end 452, extending outwardly from internal side 432, wherein each of hinge pins 405, 406 (not shown) being configured to rotatably couple to each of knuckles 265, 266 disposed on basal side 255 toward posterior end 252 of articulating lever 200 (see e.g., FIG. 8B).

As used within this disclosure, the term "detent" refers to a member providing resistance to moving a moving element (e.g., hinge pin 405) away from a particular position until at least a certain amount of force or torque is applied to the moving element, whereupon the moving element is permitted to move away from that particular position (e.g., engaged in knuckle 415). The certain amount of force is less than the amount of force or torque that will cause damage or breakage to any element associated with the detent function. The certain amount of force is greater than an amount of force that may be generated by activities not intended to move the moving element. In an embodiment adapter 10 is configured to disengage the various parts without damaging any parts, thus allowing to remove and/or replace comb 500 as needed. Comb 500 can be, for example a lice comb.

Turning now to FIGS. 1 and 8A-8C, illustrating an embodiment whereby, in the retracted position (see e.g., FIG. 1), a portion of each of articulating arms 401, 402 is accommodated within each of the open U-shaped channel of each brace formed by internal wall 202, 204 extending basally from basal side 255 of articulating lever slab 200;

floor section 261, 262; and external wall 201, 203 together (202-261-201 and 204-262-203 respectively) on articulating lever slab 200, such that lower surface 422 of articulating arm 401, 402 abuts floor sections 261, 262 respectively.

In an embodiment, the methods described herein and illustrated in FIGS. 1 and 8A-8C can utilize the adapters described hereinabove. Accordingly and in an embodiment, provided herein is a method of cleaning comb 500, implementable with adapter 10 described herein, comprising: providing comb 500; rotating articulating lever slab 200 to an extended position thereby exposing opening 120 defined in stage 102 on base 101 of platform 100; engaging comb 500 and platform 100; retracting articulating lever slab 200; combing; and rotating articulating lever slab 200 to an extended position as can be limited by for example, elongated slab 340, thereby causing proximal end 451 of articulating arms 401, 402 to move proximally within grooves 303, 304 respectively of cleaning head 300 and articulating cleaning head 300 proximally along plurality of elongated comb teeth $\mathbf{502}_j$, causing elastomeric sleeve 600 to frictionally slide wipe comb 500 and thereby cleaning plurality of elongated comb teeth $\mathbf{502}_j$.

Figure 9:
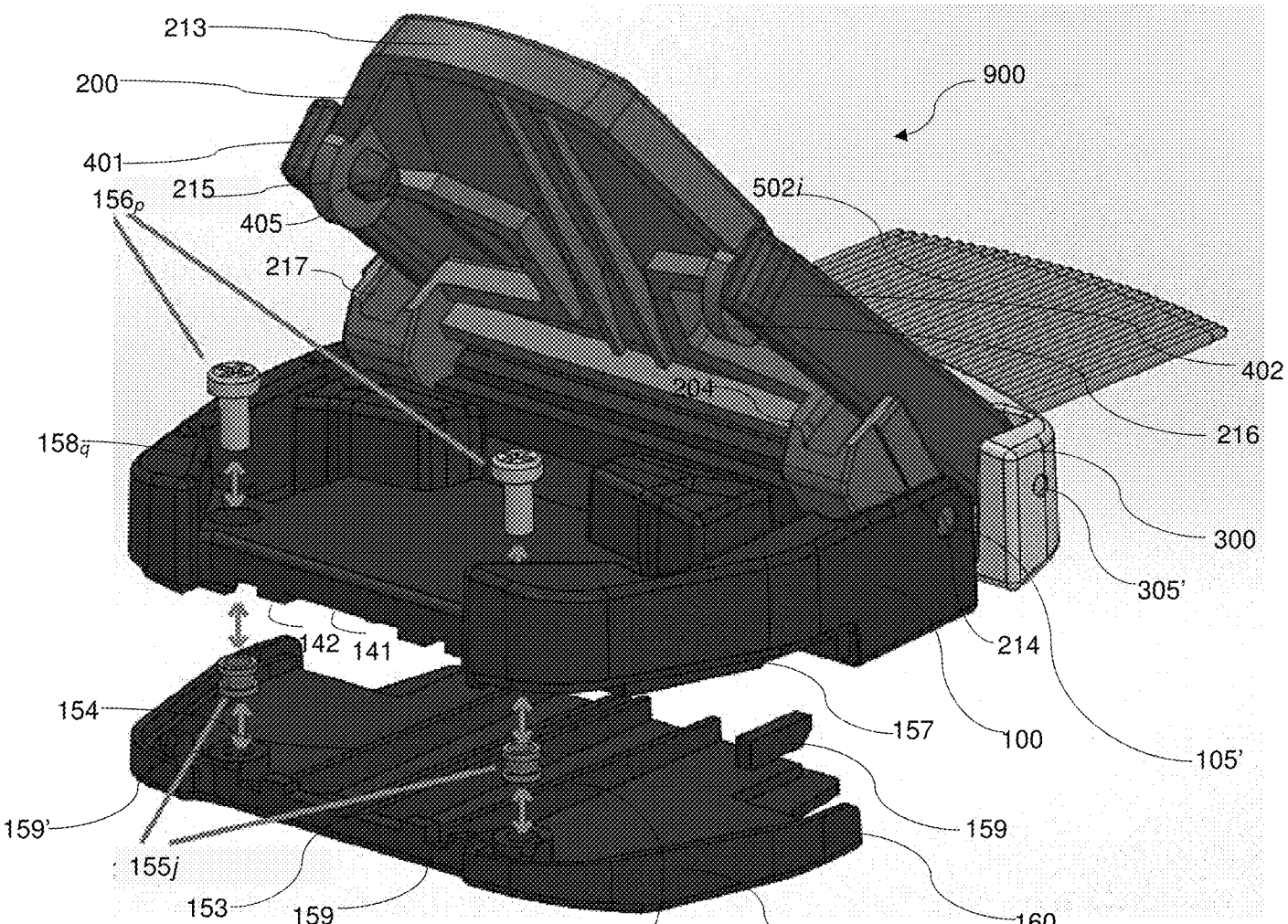
FIG. 9, illustrates a perspective view of another embodiment of the adapter integrated with a comb.
Figure 10:
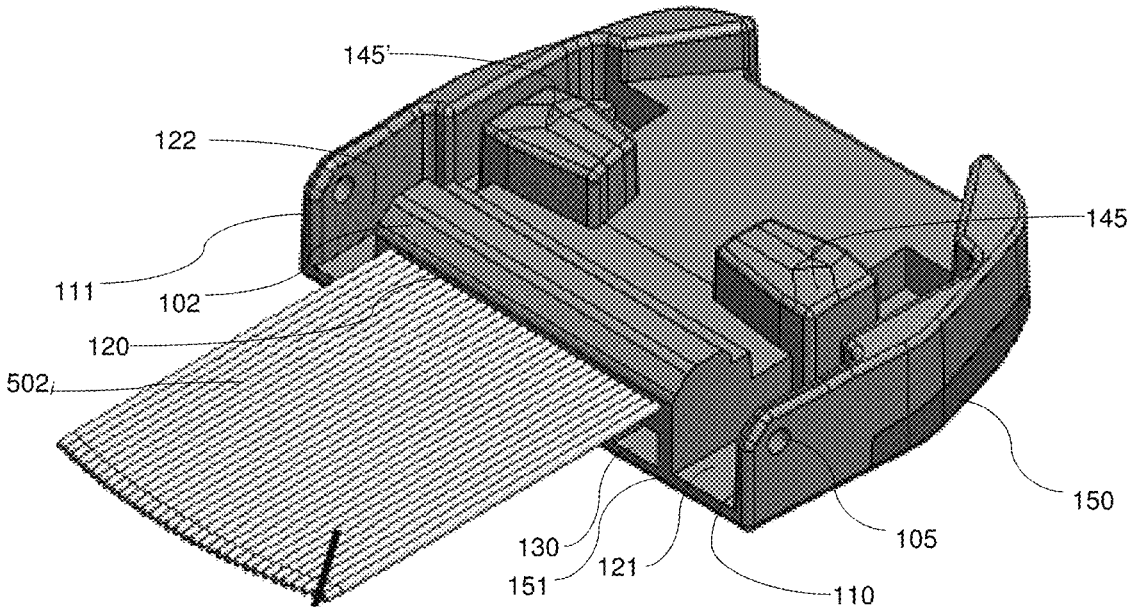
FIG. 10, illustrates a perspective view of the body portion of the adapter integrated with the body portion shown in FIG. 9.

Turning now to FIGS. 9 and 10, illustrating a perspective view of another embodiment of the adapter integrated with a comb. In other words, the comb teeth are integrated with the platform and are operably coupled to the stage. Accordingly and as illustrated, platform 100 used in the integrated cleaning adapter 900 can be adapted to comprise stage 102 disposed centrally along proximal end 151 (see e.g., FIG. 10) of platform 100, with stage 102 defining opening 120 (see e.g., FIG. 10), configured to couple to plurality of teeth 502*i*. Also illustrated in FIG. 10, is pocket 130 disposed in platform 100 base 101 (see e.g., FIG. 3A), pocket 130 configured to engage and slidably couple to a portion of cleaning head 300 such as elongated slab 340 (see e.g., FIG. 11). As further illustrated, platform 100 further comprising pair of vertical members 110, 111 disposed at equidistance from stage 102 along proximal end 151 of platform 100, each vertical member 110, 111 defining recess 121, 122, each recess 121, 122 configured to receive a portion of articulating lever slab 200 (see e.g., FIG. 9).

Further illustrated in FIG. 9, is base cap 150, configured to couple to the underside of platform 100 and form the bottom half of pocket 130, for example by pair of tabs 159, 159' (not shown) configured to operably couple to corresponding dimples in platform 100 (not shown. Base cap 150 can further comprise lip 160 configured to abut lip 157 defined on the underside of platform 100. As illustrated, base cap 150 can define rails 154, 154' configured to abut corresponding rails 141, 141' (Not shown), thus forming stoppers 131 132 in pocket 130. Coupling of base cap 150 to the underside of platform 100, can be further facilitated by pair of screws $\mathbf{156}_p$, configured to couple to bolts $\mathbf{155}_j$, where screws 156*p* extend basally through pair of orifices 158*q*, engaging bolts $\mathbf{155}_j$, for example, by friction, where bolts $\mathbf{155}_j$, can be accommodated and engaged in cups 159, 159' disposed on base cap 150 and extending apically. It is noted, that the operation of the adapter is the same as disclosed herein for FIG. 1 and where the comb is separate and distinct from the adapter. Other coupling methods are also contemplated, for example adhesion, fusion (melting/welding) for base cap 150 and the underside of platform 100.

Figure 11:
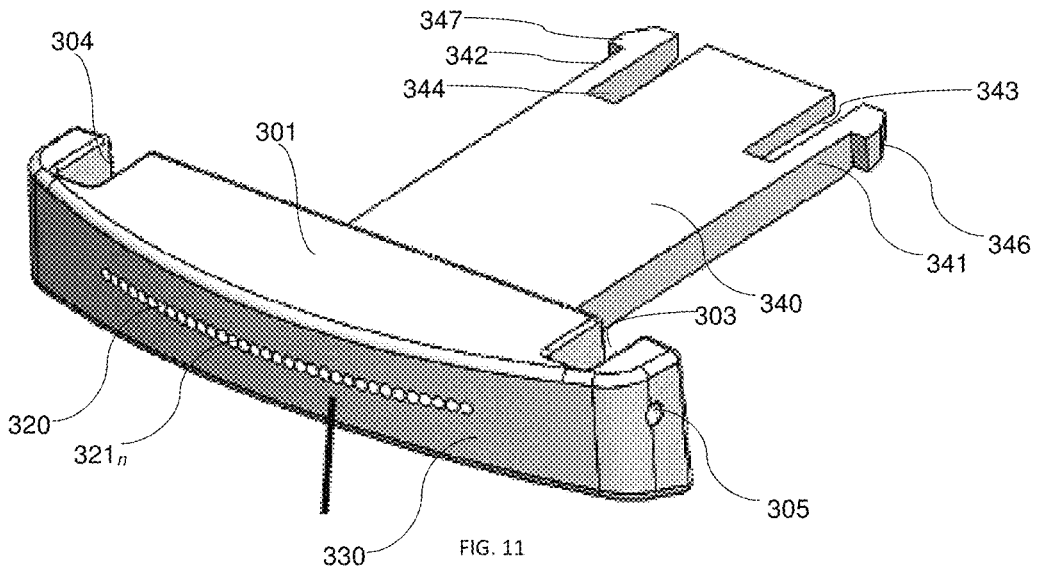
FIG. 11, illustrates a perspective view of the cleaning head used with the body portion of the adapter integrated with the body portion shown in FIG. 9.

Turning now to FIG. 11, whereby cleaning head 300 comprises upper surface 301 and lower surface 302 (see e.g., FIG. 3A), with cleaning head 300 defines aperture 320 defining series of holes $\mathbf{321}_n$, which may be formed by sharply undulating bottom half abutting complimentary undulating top half thus forming a series of parallel axes of curvature, configured to receive and slidably abut plurality of teeth $\mathbf{502}_i$. As used herein, the term 'undulating' refers to the shape imparted to a planar honeycomb panel in which a simple or complex undulating wave form is formed generally of one or more curvatures having axes of curvature which are generally parallel.

As illustrated in FIG. 11, cleaning head 300 further comprises elongated slab 340 extending distally from lower surface 302 of cleaning head 300, whereby elongated slab 340 further comprises pair of resilient extensions 341, 342, each resilient extension terminating in tab 346, 347 respectively and forming groove 343, 344 respectively with elongated slab 340, with tabs 346, 347 configured to be engaged and elongated slab 340 being slidably coupled within pocket 130 in base 101 of platform 100.

Cleaning head 300 used in integrated comb adapter 900 (and/or adapter 10), can be formed of a thermoplastic polymer composition having a static coefficient of friction (COF) against steel of between about 0.09 and about 0.30 and a dynamic coefficient of friction (COF) against steel of between about 0.23 to about 0.50, for example, poly(acetal) POM. In an embodiment, the thermoplastic polymer forming the cleaning head is a composition comprising poly (acetal) and poly(tetrafluoroethylene) at a ratio of between 9:1 and about 17:3.

Figure 12:
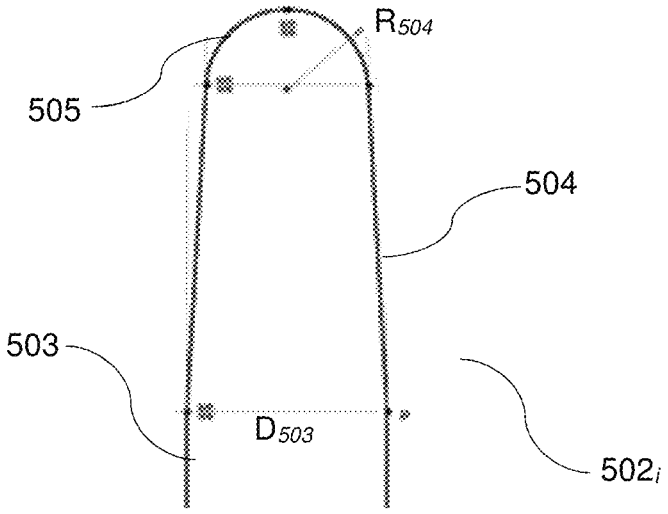
FIG. 12, illustrates elevation view of an embodiment of the comb teeth.

Turning now to FIG. 12, illustrating $i^{th}$ teeth of the plurality of teeth 502*i*, whether on adapter 10 (FIG. 1) or integrated adapter 900 (FIGS. 9-11). As illustrated, unlike in the typical lice comb teeth configuration available, each $i^{th}$ teeth of the plurality of teeth 502*i*, is configured to have cylindrical base portion 503 having a diameter $D_{503}$ that is frictionally accommodated in the series of holes 321*n*; tapered mid portion 504, terminating in a spheroidal tip 505 having tip radius $R_{505}$, that forms a diameter that is smaller than base diameter $D_{503}$. The configuration of the teeth described herein is adapted in an embodiment, to allow removal of dandruff, nits, and/or lice from face 330 of cleaning head 300 when in fully extended position, without forming a space between the teeth that will allow harboring of undesirable material, which may take place with a sharpened conical tip under currently available technology. Accordingly and in an embodiment, comp teeth 502*i* extending proximally from stage 102 in either adapter 10 or integrated adapter 900, comprise cylindrical base portion 503 having a diameter $D_{503}$ that is frictionally accommodated in the series of holes 321*n*; tapered mid portion 504, terminating in a spheroidal tip 505 having tip radius $R_{505}$, that forms a diameter that is smaller than base diameter $D_{503}$.

Further and in an embodiment, provided herein is a kit of parts capable of being assembled into a comb cleaning adapter, the adapter configured to reversibly operate between a retracted position and an expanded position, comprising: a platform having a distal end and a proximal end, configured to receive and engage a portion of a comb, wherein the comb having a head portion and a plurality of elongated teeth extending from the head portion to a given length; an articulating lever having an anterior end and a posterior end, hingedly coupled at the anterior end to the platform's proximal end, the articulating slab configured to rotate at a predetermined arc relative to the platform; and a cleaning head operably coupled to the articulating lever slab, and slidably coupled to the platform, wherein the cleaning head configured to frictionally slidably couple to the plurality of elongated teeth of the comb, wherein rotation of the articulating lever along the predetermined arc is configured to articulate the cleaning head proximally along the plurality of the comb's teeth. The comb can be a lice comb and the kit can further contain a container, for example a bottle or a canister with a composition configured to kill lice (louse), or prevent hatching of eggs (nits) or, generally to inhibit the life cycle of lice at any stage. The composition can be pediculicide such as, for example, Pyrethrins (e.g., synthetic pyrethroid such as phenothrin, permethrin, and mixtures thereof, and/or natural pyrethrin such as esters of Cinerin I, Cinerin II, Jasmolin I, Jasmolin II, Pyrethrin I, and Pyrethrin II and mixtures thereof), Piperonyl Butoxide, menthol, essential oregano oil, menthol oil, anise oil, or a composition comprising one or more of the foregoing. The composition can be aerosolized, liquid, ointment, shampoo and any other proper distribution vehicle for the composition. Furthermore, the composition can be a suspension, solution, emulsion, foam, gel and the like suspended system.

All ranges disclosed herein are inclusive of the endpoints, and the endpoints are independently combinable with each other. "Combination" is inclusive of blends, mixtures, alloys, reaction products, and the like. Furthermore, the terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the arm(s) includes one or more arm). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Moreover, "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

Also, the terms "member" or "element" when used in the singular refers to a single integrated part that moves as a unit and does not include a plurality of parts with independent and separate movement between. In other words, as used herein, the terms "member" or "element" can be made of several pieces to foam an integral unit, but does not include two or more parts with a first part that moves relative to a second part. As used herein to describe the present invention, the following directional terms "anterior", "posterior", "apical", "basal", "forward", "rearward", "above", "downward", "vertical", "horizontal", "below" "longitudinal" "lateral" and "transverse" as well as any other similar directional terms refer to those directions of the various members or elements relative to a flat horizontal surface. Accordingly, these terms, as utilized to describe the present disclosure should be interpreted relative to a bicycle equipped with the bicycle pedal as used in the normal riding position on a flat horizontal surface.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed:

1. A comb cleaning adapter, the adapter configured to reversibly operate between a retracted position and an expanded position, the adapter comprising:

a. a platform having a distal end and a proximal end, configured to receive and engage a portion of a comb, the comb having a head portion and a plurality of elongated teeth extending from the head portion to a given length, the platform further comprising:
   i. a stage disposed centrally along the proximal end of the platform, the stage defining an opening configured to accommodate and engage the head portion of the comb; and
   ii. a pocket configured to engage and slidably couple to a portion of a cleaning head;

b. an articulating lever slab having an apical side, a basal side, an anterior end, and a posterior end, hingedly coupled at the anterior end to the platform's proximal end, the articulating lever slab configured to rotate at a predetermined arc relative to the platform and further comprising:
   i. a cross bar disposed toward the anterior end of the articulating lever slab;
   ii. a pair of braces disposed on opposite sides along the anterior end and extending basally and anteriorly; and
   iii. a pair of knuckles disposed toward the posterior end of the articulating lever slab, each knuckle couple to a distal portion of a pair of articulating arms hingedly coupled to the knuckles;

c. the cleaning head operably coupled to the articulating lever slab, and slidably coupled to the platform, the cleaning head further comprising an elongated slab extending distally from the lower surface of the cleaning head, the elongated slab configured to be engaged and slidably coupled within the pocket in the platform;

d. the pair of articulating arms, wherein:
   i. each articulating arm has a proximal end hingedly coupled to the cleaning head and a distal end hingedly coupled to the knuckles on the articulating lever slab; and
   ii. each of the articulating arms has an internal side and an external side, with a pair of hinge pins disposed toward the distal end, extending from the internal side, wherein each hinge pin is configured to rotatably couple to each of the knuckles disposed toward the posterior end of the articulating lever slab; and e. a pair of vertical members disposed at equidistance from the stage along the proximal end of the platform, defining a recess configured to receive a portion of the articulating lever slab, wherein the cleaning head is configured to frictionally slidably couple to the plurality of elongated teeth of the comb, wherein rotation of the articulating lever slab along the predetermined arc is configured to articulate the cleaning head proximally along the plurality of the comb's teeth.

2. The adapter of claim 1, wherein each brace comprises: an internal wall extending basally from the basal side of the articulating lever slab; a floor section; and an external wall forming an open U-shaped channel, wherein the recesses defined by each of the pair of vertical members and the stage disposed on the platform is configured to accommodate and hingedly couple to each of the braces.

3. The adapter of claim 1, wherein the cleaning head comprises an upper surface and a lower surface, a proximal end and a distal end, the cleaning head defines an aperture configured to receive and engage an elastomeric insert.

4. The adapter of claim 3, wherein the insert is an elastomeric sleeve defining a slit with a plurality of opposite protrusions configured to frictionally slidably couple to the plurality of elongated comb teeth.

5. The adapter of claim 1, wherein the cleaning head further defines a pair of grooves cut into a front facet of the cleaning head and disposed on opposite sides along the proximal end of the cleaning head, wherein each groove is configured to receive and hingedly couple to a proximal portion of the articulating arm.

6. The adapter of claim 5, wherein the elongated slab extending distally from the lower surface of the cleaning head is configured to limit the arc of rotation of the articulating lever slab and limit the proximal movement of the cleaning head along the plurality of elongated comb teeth.

7. The adapter of claim 1, wherein each of the hinge pin is a detent.

8. The adapter of claim 7, wherein, in the retracted position, a portion of each of the articulating arms is accommodated within each of the open U-shaped channel of each brace on the articulating lever slab.

9. The adapter of claim 1, wherein the comb is a lice comb.

10. A method of cleaning a comb, implementable with the adapter of claim 1, comprising:

a. providing a comb;
b. rotating the articulating lever slab to an extended position;
c. engaging the comb and the platform;
d. retracting the articulating lever slab;
e. combing; and
f. rotating the articulating lever slab to an extended position, thereby articulating the cleaning head proximally along the plurality of elongated comb teeth, thereby cleaning the plurality of elongated comb teeth.

11. The method of claim 10, wherein the comb is a lice comb.

12. An integrated comb cleaning adapter comprising:

a. a platform having a distal end and a proximal end, having a plurality of elongated teeth extending from the distal end to a given length, in the platform further comprising:
   i. a stage disposed centrally along the proximal end of the platform, the stage defining an opening configured to accommodate and engage the head portion of the comb; and
   ii. a pocket configured to engage and slidably couple to a portion of a cleaning head;
b. an articulating lever slab having an apical side, a basal side, an anterior end, and a posterior end, hingedly coupled at the anterior end to the platform's proximal end, the articulating lever slab configured to rotate at a predetermined arc relative to the platform and further comprising:
   i. a cross bar disposed toward the anterior end of the articulating lever slab;
   ii. a pair of braces disposed on opposite sides along the anterior end and extending basally and anteriorly; and
   iii. a pair of knuckles disposed toward the posterior end of the articulating lever slab, each knuckle couple to a distal portion of a pair of articulating arms hingedly coupled to the knuckles;
c. the cleaning head operably coupled to the articulating lever slab, and slidably coupled to the platform, the cleaning head further comprising an elongated slab extending distally from the lower surface of the cleaning head, the elongated slab configured to be engaged and slidably coupled within the pocket in the platform;
d. the pair of articulating arms, wherein:
   i. each articulating arm has a proximal end hinged coupled to the cleaning head and a distal end hingedly coupled to the corresponding knuckle on the articulating lever slab; and
   ii. each of the articulating arms has an internal side and an external side, with a pair of hinge pins disposed toward the distal end, extending from the internal side, wherein each of hinge pin is configured to rotatably couple to each of the knuckles disposed toward the posterior end of the articulating lever slab; and
e. a pair of vertical members disposed at equidistance from the stage along the proximal end of the platform, defining a recess configured to receive a portion of the articulating lever slab, wherein the cleaning head is configured to frictionally slidably couple to the plurality of elongated teeth, wherein rotation of the articulating lever slab along the predetermined arc is configured to articulate the cleaning head proximally along the plurality of teeth.

13. The integrated comb cleaning adapter of claim 12, wherein the plurality of teeth extends proximally from the stage.

14. The integrated comb cleaning adapter of claim 12, wherein the cleaning head comprises an upper surface and a lower surface, a proximal end and a distal end, the cleaning head defines an aperture configured to receive and engage the plurality of teeth extending proximally from the stage.

15. The integrated comb cleaning adapter of claim 12, wherein the cleaning head further defines a pair of grooves cut into a front facet of the cleaning head and disposed on opposite sides along the proximal end of the cleaning head, wherein each groove is configured to receive and hingedly couple to a proximal portion of each of the articulating arms respectively.

16. The integrated comb cleaning adapter of claim 15, wherein the elongated slab extending distally from the lower surface of the cleaning head is configured to limit the arc of rotation of the articulating lever slab and limit the proximal movement of the cleaning head along the plurality of elongated comb teeth.

17. The integrated comb cleaning adapter of claim 16, wherein the cleaning head is formed of a thermoplastic polymer having a static coefficient of friction (COF) against steel of between about 0.09 and about 0.30 and a dynamic coefficient of friction (COF) against steel of between about 0.23 to about 0.50.

18. The integrated comb cleaning adapter of claim 17, wherein, in the retracted position, a portion of each of the pair of articulating arms is accommodated within each of the open U-shaped channel of each brace on the articulating lever slab.

19. The integrated comb cleaning adapter of claim 17, wherein the thermoplastic polymer is poly(acetal) (POM).

* * * * *